US007559174B2

(12) United States Patent
Hoberman

(10) Patent No.: US 7,559,174 B2
(45) Date of Patent: Jul. 14, 2009

(54) COVERING STRUCTURE HAVING LINKS AND STEPPED OVERLAPPING PANELS BOTH OF WHICH ARE PIVOTABLE BETWEEN EXTENDED POSITION AND A RETRACTED POSITION IN WHICH THE PANELS ARE STACKED

(76) Inventor: Charles Hoberman, 472 Greenwich St., New York, NY (US) 10013

( * ) Notice: Subject to any disclaimer, the term of this patent is extended or adjusted under 35 U.S.C. 154(b) by 0 days.

(21) Appl. No.: 11/749,304

(22) Filed: May 16, 2007

(65) Prior Publication Data

US 2007/0266648 A1 Nov. 22, 2007

Related U.S. Application Data

(60) Provisional application No. 60/801,807, filed on May 19, 2006.

(51) Int. Cl.
*E04B 7/16* (2006.01)

(52) U.S. Cl. ..... 52/66

(58) Field of Classification Search ..... 52/80.1, 52/81.5, 64, 108, 109, 82, 66, 90.1; 135/131, 135/98, 99

See application file for complete search history.

(56) References Cited

U.S. PATENT DOCUMENTS 1,445,402 A * 2/1923 Le Velle ..... 416/87
3,000,386 A * 9/1961 Schulze et al. ..... 135/145
3,375,624 A * 4/1968 Mikulin ..... 52/109
4,023,582 A * 5/1977 Buzzella et al. ..... 135/15.1
4,156,433 A * 5/1979 Beaulieu ..... 135/145
4,587,775 A * 5/1986 Lewis et al. ..... 52/65
4,616,451 A * 10/1986 Glick ..... 52/66
4,676,033 A * 6/1987 Allen et al. ..... 52/6
4,706,419 A * 11/1987 Adachi et al. ..... 52/65
4,738,057 A * 4/1988 Logan ..... 52/2.17
4,751,800 A * 6/1988 Kida et al. ..... 52/66
4,780,344 A 10/1988 Hoberman
4,942,698 A * 7/1990 Kumagai ..... 52/6
4,942,700 A 7/1990 Hoberman
4,981,732 A 1/1991 Hoberman
5,024,031 A * 6/1991 Hoberman ..... 52/81.2
5,203,125 A * 4/1993 Sugizaki ..... 52/66
5,234,727 A 8/1993 Hoberman
5,371,983 A * 12/1994 Kawaguchi et al. ..... 52/81.1
5,625,982 A * 5/1997 Foote ..... 52/64
5,651,228 A * 7/1997 Zeigler ..... 52/646

(Continued)

*Primary Examiner*—Gay A Spahn
(74) *Attorney, Agent, or Firm*—Gottlieb, Rackman & Reisman

(57) ABSTRACT

An assembly comprising at least two movable panels, each having an elongated profile and at least two pivot connections is provided. The assembly also includes at least two links, each link comprised of at least two pivot connections, each of which is offset from one another both in the plane orthogonal to the axis of the pivots as well as offset from one another along the vector defined by the axis of the pivots itself. The assembly further includes a single fixed member to which the two or more links are pivotally attached. The movable panels are each pivotally attached to at least two of the two or more links. The assembly may take an extended configuration wherein the panels form a continuous surface having a polygonal profile in plan and a stepped profile in elevation. The assembly may take on a retracted configuration such that the panels are essentially stacked over one another to form a compact bundle having an elongated profile.

15 Claims, 13 Drawing Sheets

U.S. PATENT DOCUMENTS 6,003,269 A * 12/1999 McRee ..... 52/6
6,082,056 A 7/2000 Hoberman
6,190,231 B1 2/2001 Hoberman
6,219,974 B1 * 4/2001 Hoberman ..... 52/81.5
6,273,115 B1 * 8/2001 Guggisberg ..... 135/135
6,421,966 B1 * 7/2002 Braunstein et al. ..... 52/173.3
6,739,098 B2 * 5/2004 Hoberman ..... 52/109
6,834,465 B2 12/2004 Hoberman
7,044,145 B2 * 5/2006 Bouchard ..... 135/98
2002/0112413 A1 8/2002 Hoberman
2004/0134157 A1 7/2004 Hoberman
2004/0226221 A1 * 11/2004 Regnery ..... 49/74.1
2005/0097832 A1 5/2005 Hoberman
2005/0098947 A1 5/2005 Hoberman et al.
2006/0060401 A1 * 3/2006 Bole ..... 180/68.1
2006/0140769 A1 * 6/2006 Frampton et al. ..... 416/210 R

* cited by examiner

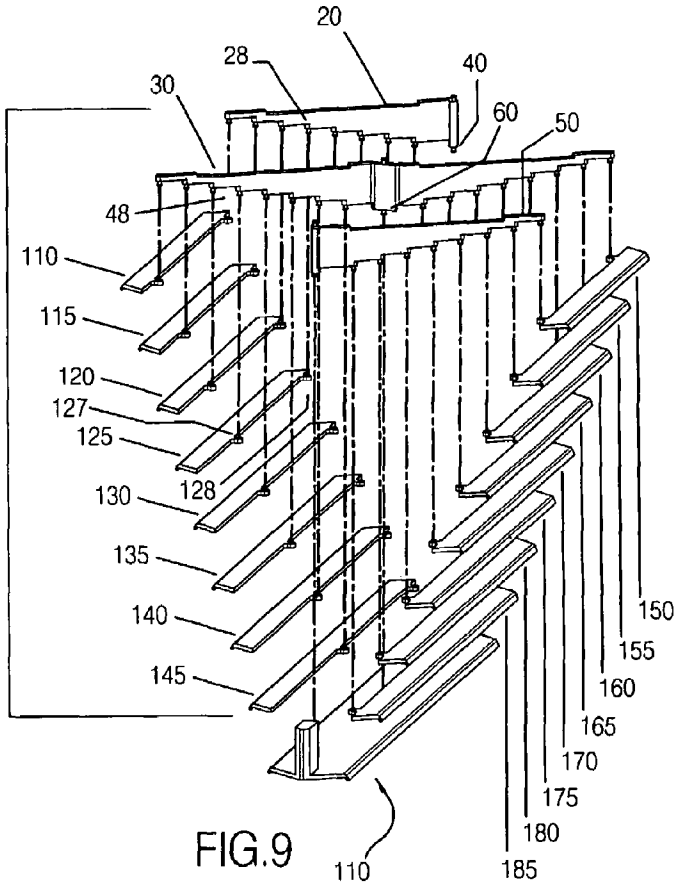
FIG.9
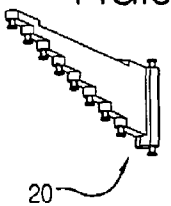
FIG.3
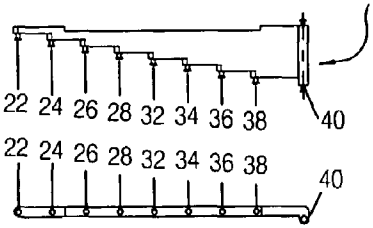
FIG.1
FIG.2
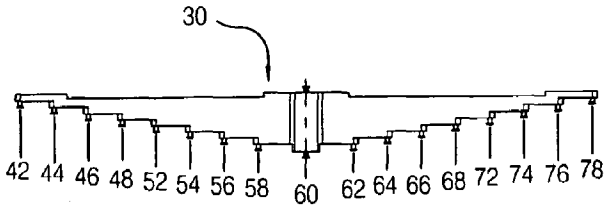
FIG.4
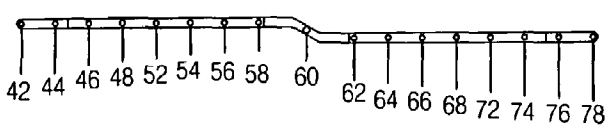
FIG.5
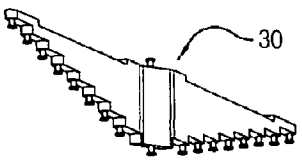
FIG.6
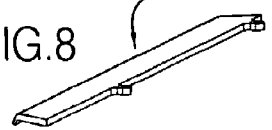
FIG.8
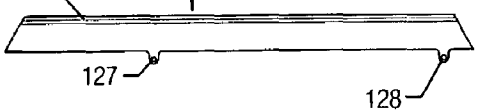
FIG.7

405
410
411
412
413
414
415
416
418
420
422
424
426
428
430

405
410
412
413
414
415
416
418
420
422
424
426
428
430

500
512
514
516
518
520
522
524
526
528

COVERING STRUCTURE HAVING LINKS AND STEPPED OVERLAPPING PANELS BOTH OF WHICH ARE PIVOTABLE BETWEEN EXTENDED POSITION AND A RETRACTED POSITION IN WHICH THE PANELS ARE STACKED

This application claims priority benefit of Provisional Application No. 60/801,807, filed May 19, 2006.

BACKGROUND OF THE INVENTION

There is often a need for adaptable coverings that can provide shade, can transform a space from indoors to outdoors, or can otherwise adjust to changing environmental conditions.

One well-known example is an operable roof over a sports arena, covering the stadium during inclement weather and then retracting when the weather improves. Such roofs are usually in the form of a wheeled structure wherein a large roof section is rolled along tracks to provide an opening.

One drawback of such systems is the relatively large amount of covering that remains even after the roof is retracted. Another limitation is that such roofs require significant structural depth since, effectively, the roof takes on a double height when retracted.

As an alternative design, my inventions under U.S. Pat. Nos. 5,024,031 and 6,739,098 disclose retractable structures that transform in the manner of diaphragms, smoothly retracting to compact rings. Structures according to these inventions overcome the limitation of wheeled roofs because they provide an essentially complete opening. These types of structures are best implemented in a circular plan or an elliptical plan.

This method has proven effective in building a number of transformable structures both as retractable domes and as retractable facades. It does, however, have the potential drawback of requiring a relatively large number of joints and moving parts. It is also not well suited to right-angled geometries. I have discovered a novel method for building retractable coverings based on new principles which overcomes certain limitations of previous methods. Under the present invention, structures are disclosed that provide continuous covering and can also fold down to a slim and compact profile. This method requires a relatively small number of joints and moving parts. Structures according to this disclosure are particularly well suited to square and rectangular shapes, thus fitting well with typical building designs.

A second useful application for the present invention to provide shading devices. When configured for this use, the invention exhibits useful properties that are not common among standard devices such as blinds, shades and louvered systems. Such existing systems, while well-suited to simple shapes (largely rectangular) are difficult to configure for alternate geometries. Also, in the case of shades and blinds, it can be quite difficult to provide a non-vertical orientation.

The disclosed invention may be easily configured to overcome all of these limitations. Further, due to its mechanical simplicity and solidity, it is particularly well suited to motorized control.

SUMMARY OF THE INVENTION

An assembly is herein disclosed comprising at least two movable panels, each having an elongated profile and at least two pivot connections, at least two links, each link having at least two pivot connections which are offset from one another both in the plane orthogonal to the axis of the pivots as well along the vector defined by the axis of the pivots itself, and a single fixed member to which the two or more links are pivotally attached. The assembly may take an extended configuration wherein the panels form a continuous surface having a polygonal profile in plan and a stepped profile in elevation, and the assembly may take on a retracted configuration such that the panels are essentially stacked one over the other to form a compact bundle having an elongated profile.

BRIEF DESCRIPTION OF THE DRAWINGS

FIG. 1 shows an elevation view of a typical link 20.

FIG. 2 shows a plan view of link 20.

FIG. 3 shows a perspective view of link 20.

FIG. 4 shows an elevation view of link 30 which is also a typical link according to the present invention.

FIG. 5 shows a plan view of link 30.

FIG. 6 shows a perspective view of link 30.

FIG. 7 shows a panel 125 which is another typical component.

FIG. 8 shows a perspective view of panel 125.

FIG. 9 shows an exploded view of assembly 10 which is comprised of a multiplicity of links and panels.

DESCRIPTION OF THE DRAWINGS

Figure 12:
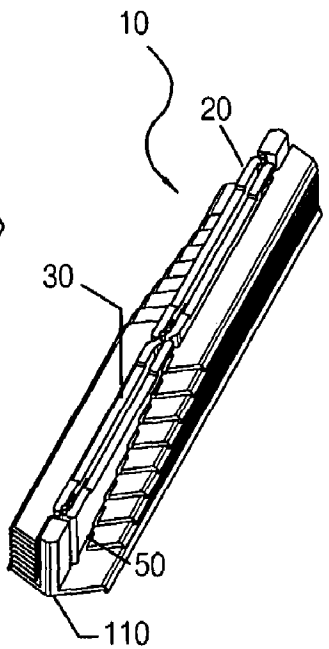
FIG. 12 shows assembly 10 in a fully retracted position.

FIG. 1 shows an elevation view of link 20 which is a typical component of the disclosed invention. Link 20 has a base pivot 40 and eight other pivots 22, 24, 26, 28, 32, 34, 36 and 38 which are arranged in stepwise fashion relative to one another.

FIG. 2 shows a plan view of link 20. Pivots 22, 24, 26, 28, 32, 34, 36 and 38 are co-linear, however, base pivot 40 does not lie on the same common line as the other eight pivots.

FIG. 3 shows a perspective view of link 20.

FIG. 4 shows an elevation view of link 30 which is has a base pivot 60. Link 30 has eight pivots 42, 44, 46, 48, 52, 54, 56 and 58 which lie on one side of base pivot 60. Additionally link 30 has eight other pivots 62, 64, 66, 68, 72, 74, 76 and 78 which lie on the other side of base pivot 60.

FIG. 5 shows a plan view of link 30. Pivots 42, 44, 46, 48, 52, 54, 56 and 58 are co-linear. Pivots 62, 64, 66, 68, 72, 74, 76 and 78 are also co-linear, however, they do not lie along the same line as the first eight pivots. Base pivot 60 does not lie on a common line with the other pivots.

FIG. 6 shows a perspective view of link 30.

FIG. 7 shows a panel 125 which is another component of the disclosed invention. Panel 125 is comprised of a surface element 126 as well as two pivots 127 and 128. Pivots 127 and 128 lie outside of the main surface of element 126.

FIG. 8 shows a perspective view of panel 125.

FIG. 9 shows an exploded view of assembly 10 which is comprised of sixteen moving panels 110, 115, 120, 125, 130, 135, 140, 145, 150, 155, 160, 165, 170, 175, 180 and 185 as well as three drive links 20, 30 and 50.

Additionally assembly 10 is comprised of one base panel 110 to which the three drive links are pivotally aligned.

It may be seen that pivot 48 belonging to link 30 is aligned with pivot 127 belonging to panel 125. Additionally, pivot 28 belonging to link 20 is aligned with pivot 128 belonging to panel 125. In similar fashion, every pivot belonging to each of the three links 20, 30 and 50 is aligned to a pivot belonging to one of the moving panels. It may be further seen that each base pivot of each link is aligned with pivots belonging to the base panel.

Figure 10:
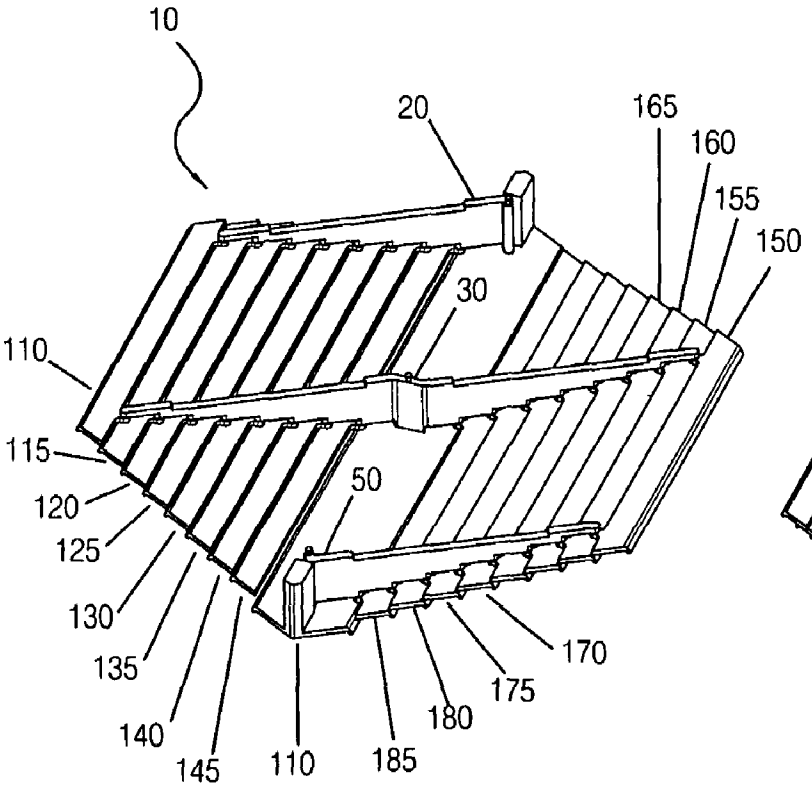
FIG. 10 shows a perspective view of assembly 10 in a fully extended position.

FIG. 10 shows a perspective view of assembly 10 in a fully extended position wherein the pivots belonging to links 20, 30 and 50 have been connected to the pivots belonging to the panels in the assembly. Each panel is connected to two out of the three links 20, 30 and 50. Link 20 is connected to panels 110, 115, 120, 125, 130, 135, 140 and 145. Link 50 is connected to panels 155, 160, 165, 170, 175, 180 and 185. Link 30 is connected to each of the sixteen panels.

In its fully extended position, it may be seen that assembly 10 forms a stepped surface having a hexagonal profile.

Figure 11:
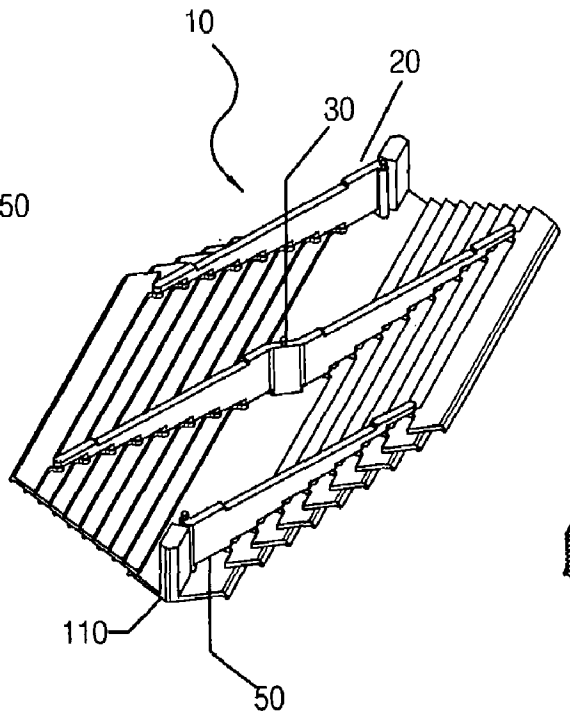
FIG. 11 shows a perspective view of assembly 10 in a partially retracted position.

FIG. 11 shows a perspective view of assembly 10 in a partially retracted position. FIG. 12 shows assembly 10 in a fully retracted position wherein it forms a compact linear bundle.

Figures 13, 14, 15, 16, 17, 18, 19, 20:
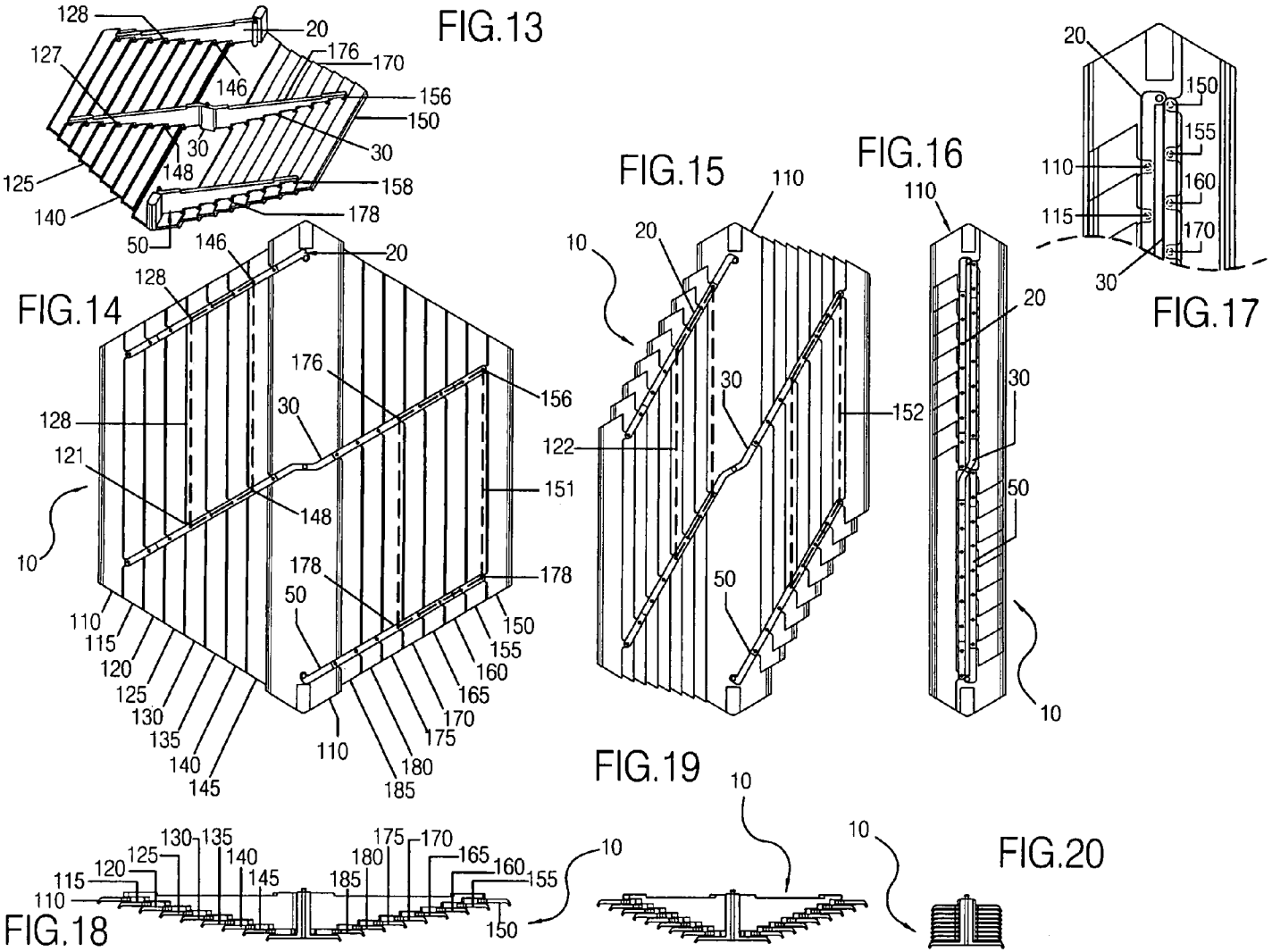
FIG. 13 again shows a perspective view of assembly 10 in its extended position.
FIG. 14 shows a plan view of assembly 10 in its fully extended position forming a hexagonal-shaped surface and further shows geometric shapes forming parallelograms which are a feature of the present invention.
FIGS. 15 and 16 show plan views of assembly 10 in a partially extended and retracted positions respectively.
FIG. 17 shows a detail of assembly 10 in its retracted position
FIGS. 18, 19 and 20 shows elevation views of assembly 10 in an extended, partially extended and retracted position respectively.

FIG. 13 shows a perspective view of assembly 10 in its extended position. In this view it may be seen that panel 125 is connected to link 20 by pivot 128.

Panel 125 is also connected to link 30 by pivot 127.

Panel 140 is connected to links 20 and 30 by pivots 146 and 148 respectively. Panel 170 is connected to links 30 and 50 by pivots 176 and 178 respectively. Panel 150 is connected to links 30 and 50 by pivots 156 and 158 respectively.

FIG. 14 shows a plan view of assembly 10 in its fully extended position forming a hexagonal-shaped surface. The four-sided shape 121 whose vertices are defined by pivots 127, 128,1 46 and 148 is a parallelogram. The shape 151 whose vertices are defined by pivots 176, 178, 158 and 156 is also a parallelogram.

FIG. 15 shows assembly 10 in a partially extended position thereby forming a distorted six-sided surface. Again, the four-sided shape 122 whose vertices are defined by pivots 127, 128, 146 and 148 is a parallelogram. The shape 152 whose vertices are defined by pivots 176, 178, 158 and 156 is also a parallelogram.

Further, any four-sided shape that is constructed by connecting the endpoints of two lines, each line being formed from the two pivots belonging to a given panel, that four-sided shape will be a parallelogram.

FIG. 16 shows a plan view of assembly 10 in its fully retracted position forming a linear bundle.

FIG. 17 shows a detail of assembly 10 in its retracted position. The pivot region of panel 110 which extends from the main surface area of panel 10 is shown in dashed line. This offset position allows panel 110 to lie in a close parallel position relative to link 20. Similarly the pivot regions of panels 115, 150, 155, 160 and 165, all shown in dashed line, extend from the main surface areas of their respective panels, allowing them to lie in close parallel conditions to links 20 and 30.

FIG. 18 shows an elevation view of assembly 10 in its fully extended position. Panel 110 forms an overlapping region with its neighboring panel 115. It may be further observed that each panel overlaps its neighbor thereby creating a completely covered surface.

FIGS. 19 and 20 show assembly 10 in its partially extended and fully retracted positions respectively. As assembly 10 retracts, each panel translates relative to its neighboring panel such that when assembly 10 is fully retracted the panels are stacked one over the other.

Figure 21:
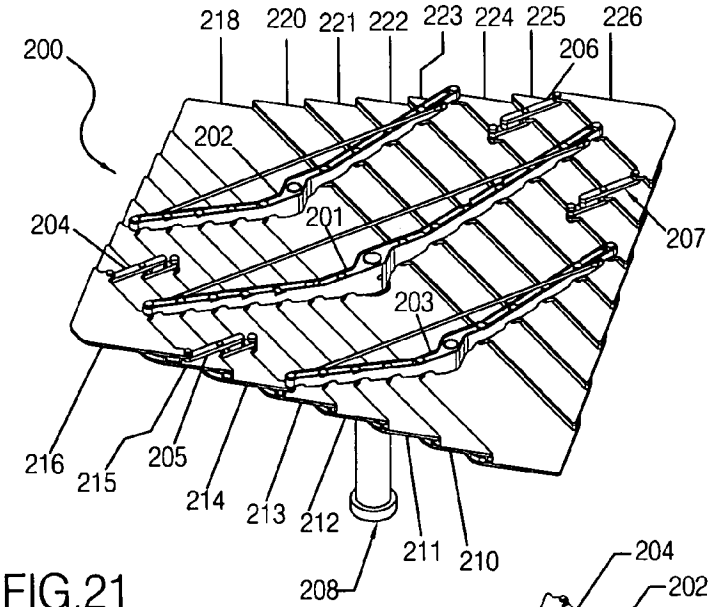
FIG. 21 shows a perspective view of an alternative embodiment of the invention, assembly 200 which forms a four-sided surface.

FIG. 21 shows a perspective view of an alternative embodiment of the invention, assembly 200 which forms a four-sided surface. Assembly 200 is comprised of three structural links 201, 202 and 203. It is further comprised of four minor links 204, 205, 206 and 207 which do not provide structural support, however, they serve to provide a synchronizing function for the movement of the assembly.

Assembly 200 is further comprised of one base panel 218 to which structural links 201, 202 and 203 are pivotally attached. Further comprising the assembly are seven moving panels 210, 211, 212, 213, 214, 215 and 216 which lie on one side of base panel 218. The assembly is further comprised of seven additional moving panels 220, 221, 222, 223, 224, 225 and 226 lying on the other side of base panel 218.

Minor links 204, 205, 206 and 207 do not connect to base panel 218, however, they form connections between adjacent moving panels. For example minor link 206 is pivotally connected to panels 224, 225 and 226. Similarly minor links 205, 206 and 207 are each pivotally connected to three moving panels. Each moving panel is pivotally connected to three different links whether structural or minor.

Assembly 200 rests on base support 208 which is aligned with the base pivot of structural link 201.

Figure 22:
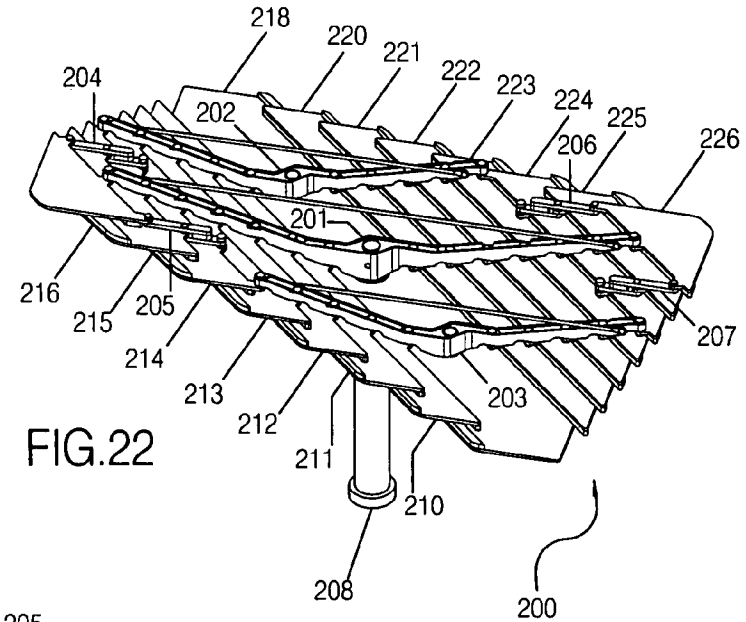
FIGS. 22 and 23 shows perspective views of assembly 200 in partially extended and retracted positions respectively.
Figure 23:
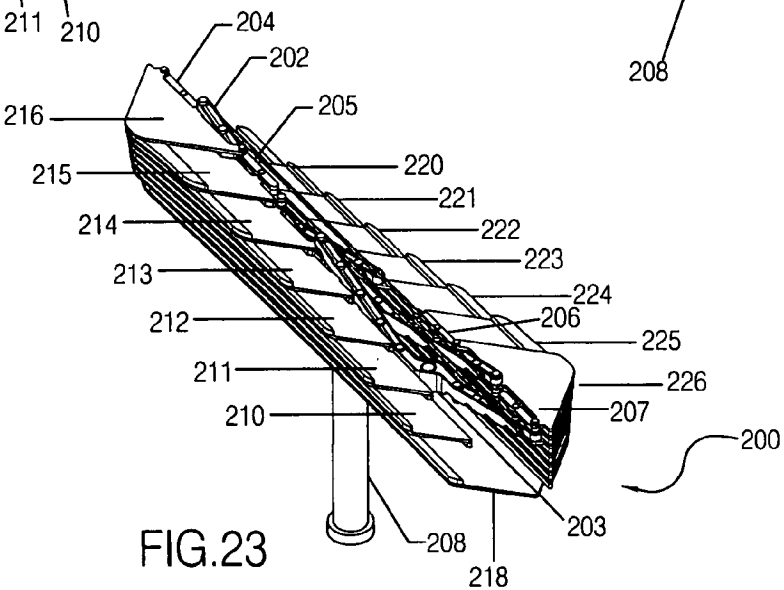

FIG. 22 shows a perspective view of assembly 200 in a partially extended state wherein the moving panels are in a translated position relative to that shown in FIG. 19. FIG. 23 shows assembly 200 in a fully retracted position wherein it forms a compact linear bundle.

Figure 26:
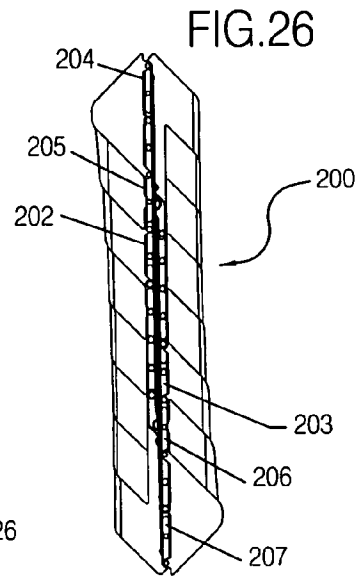
FIGS. 24, 25 and 26 shows plan views of assembly 200 in extended, partially extended and retracted positions respectively.
Figure 25:
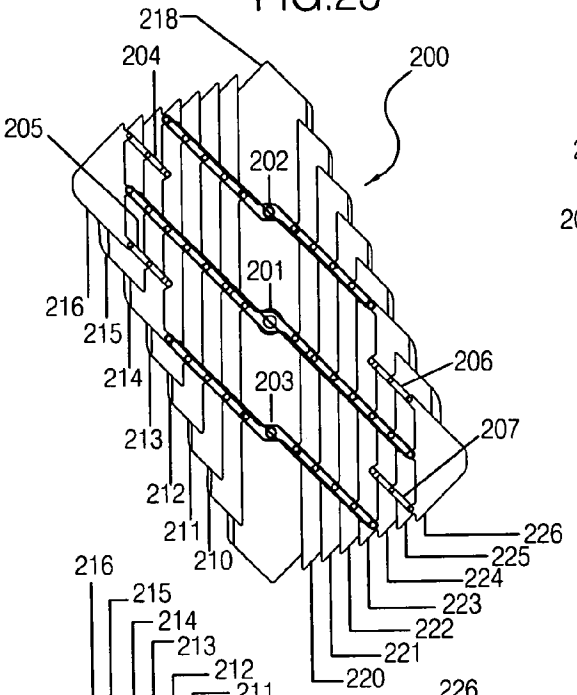
Figure 24:
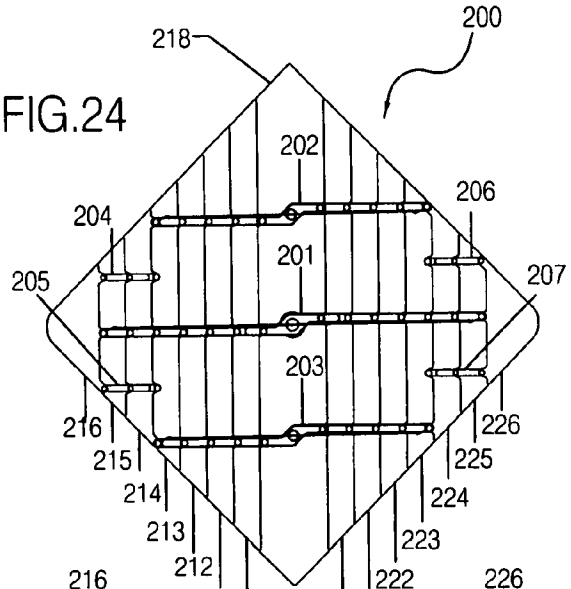

FIG. 24 shows a plan view of assembly 200 in a fully extended position where it forms a surface having an essentially square profile. FIG. 25 shows assembly 200 in a partially extended state wherein its profile has been distorted to a rectangular shape. FIG. 26 shows a plan view of the assembly in its fully retracted position where it forms a compact linear bundle.

Figure 27:
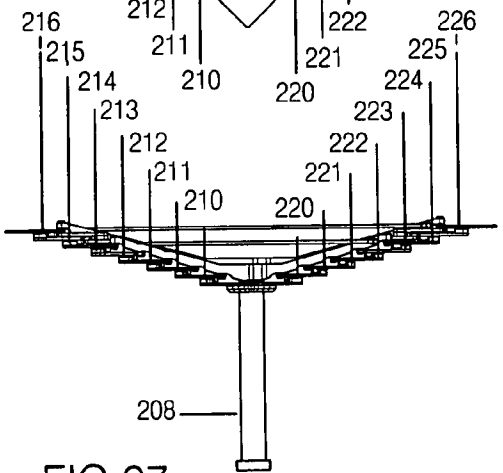

FIG. 27 shows an elevation view of assembly 200 in its extended position. Each panel may be seen to overlap its neighboring panel thereby forming a continuous covering surface.

Figure 29:
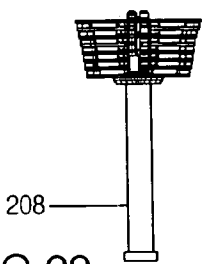
FIGS. 27, 28 and 29 shows elevation views of assembly 200 in extended, partially extended and retracted positions respectively.
Figure 28:
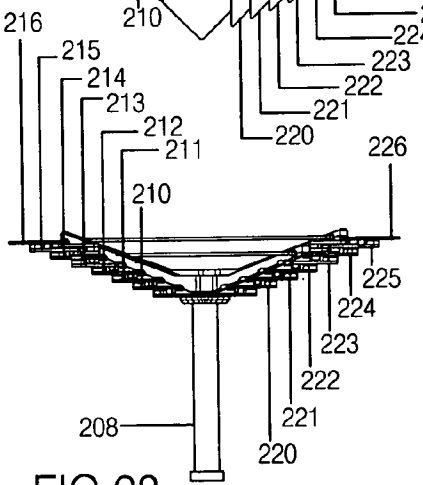

FIGS. 28 and 29 show assembly 200 in its partially extended and fully retracted positions respectively. As assembly 200 retracts, each panel translates relative to its neighboring panel such that when assembly 200 is fully retracted the panels are stacked one over the other.

Figure 30:
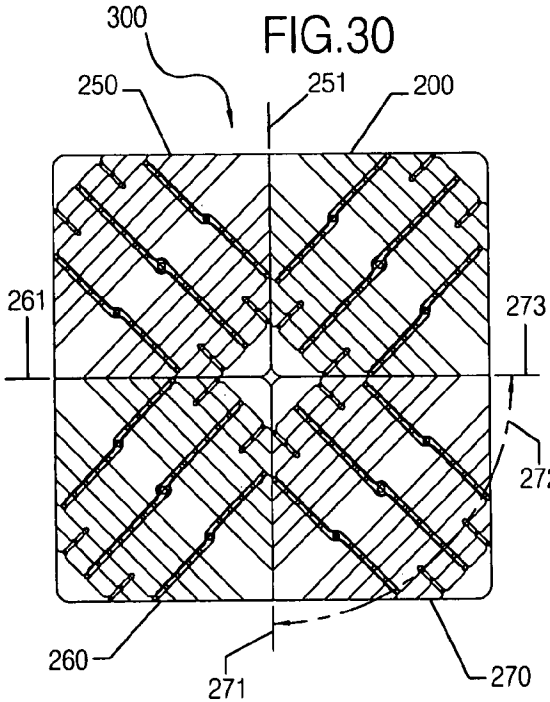
FIG. 30 shows a plan view of operable covering 300 which is comprised of four assemblies 200, 250, 260 and 270.

FIG. 30 shows a plan view of operable covering 300.which is comprised of four assemblies 200, 250, 260 and 270. Covering 300 is shown in its fully extended position. Assemblies 200 and 250 are essentially in contact along edge line 251. Similarly assemblies 250 and 260, assemblies 260 and 270, assemblies 270 and 200 are in essential contact with each other along edge lines 261, 271 and 273 respectively.

Figure 31:
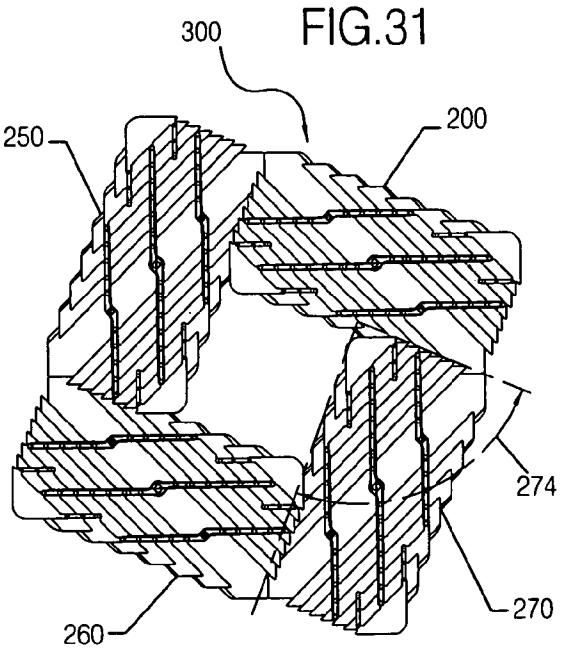

Angle 271 formed between edges lines 271 and 273 is essentially a right angle. FIG. 31 shows operable covering 300 in a partially retracted position. The edges of assemblies 200, 250, 260 and 270 remain in close proximity to their neighboring assemblies, yet do not interfere with each other. The angle 274 formed by the edges of assembly 270 essentially remains a right angle demonstrating a unique geometric feature of this embodiment of the invention.

Figure 32:
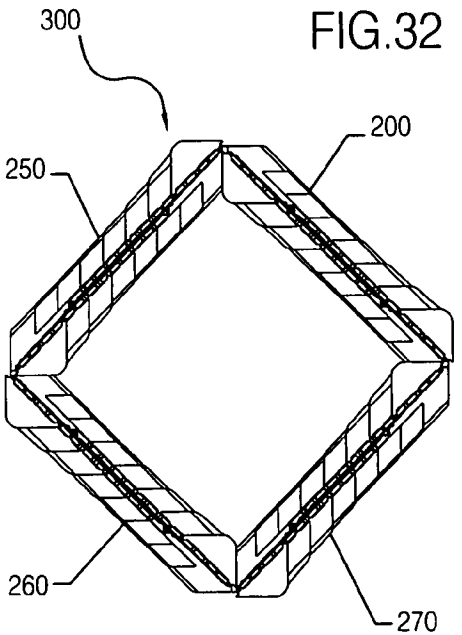
FIGS. 31 and 32 show plan views of covering 300 in partially extended and retracted positions respectively.

FIG. 32 shows operable covering in its fully retracted position where assemblies 200, 250, 260 and 270 are retracted to compact linear bundles.

Figure 35:
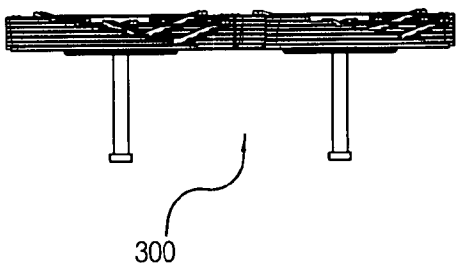
FIGS. 33, 34 and 35 show elevation views of covering 300 in extended partially extended and retracted positions respectively.
Figure 34:
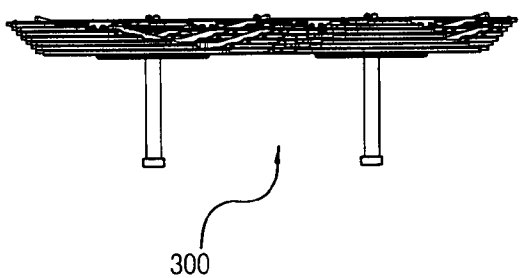
Figure 33:
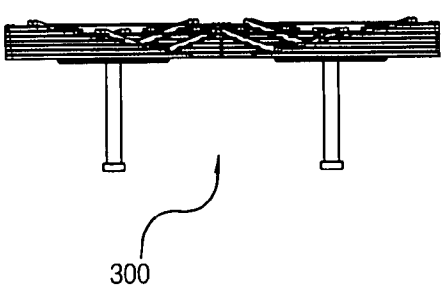

FIGS. 33, 34 and 35 show elevation views of operable covering 300 in its extended, partially extended and retracted positions respectively.

Figure 37:
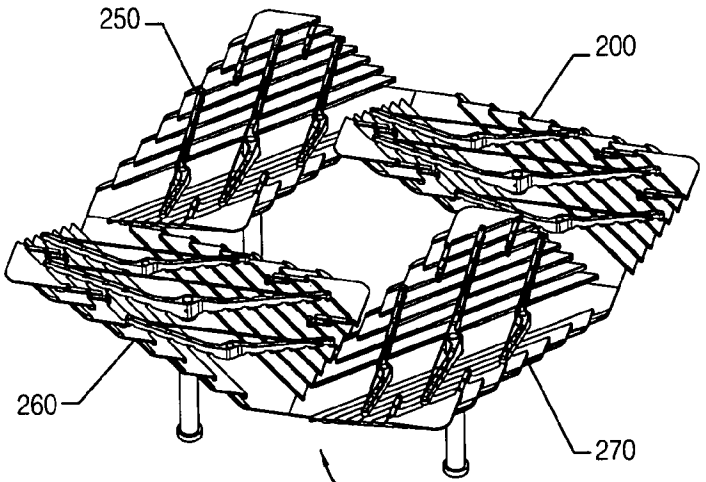
FIGS. 36, 37 and 38 show perspective views of operable covering 300 in its extended, partially extended and retracted positions respectively.
Figure 36:
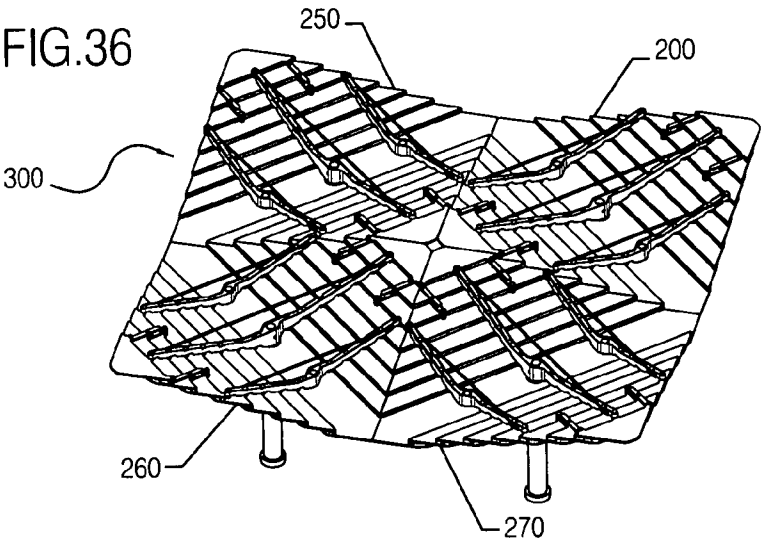
Figure 38:
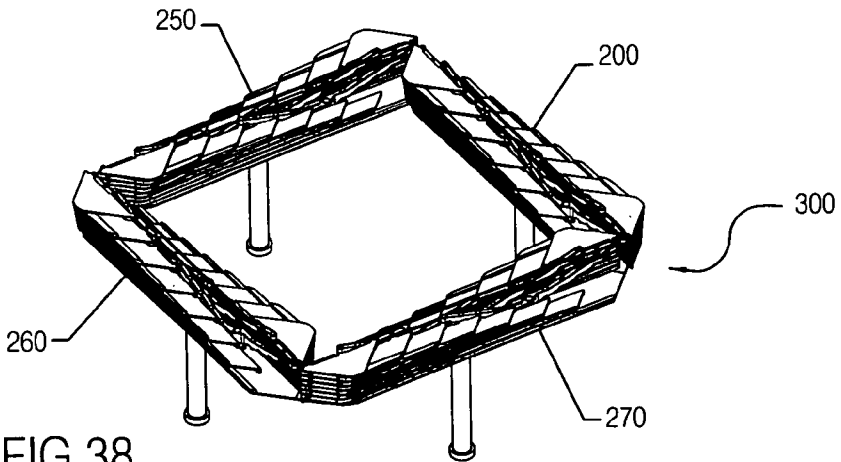

FIGS. 36, 37 and 38 show perspective views of operable covering 300 in its extended, partially extended and retracted positions respectively. In FIG. 33 it may be seen how adjacent assemblies 260 and 270 avoid interfering with each other as they retract due to the overlap of proximate panels.

Figures 39, 40, 41, 42, 43:
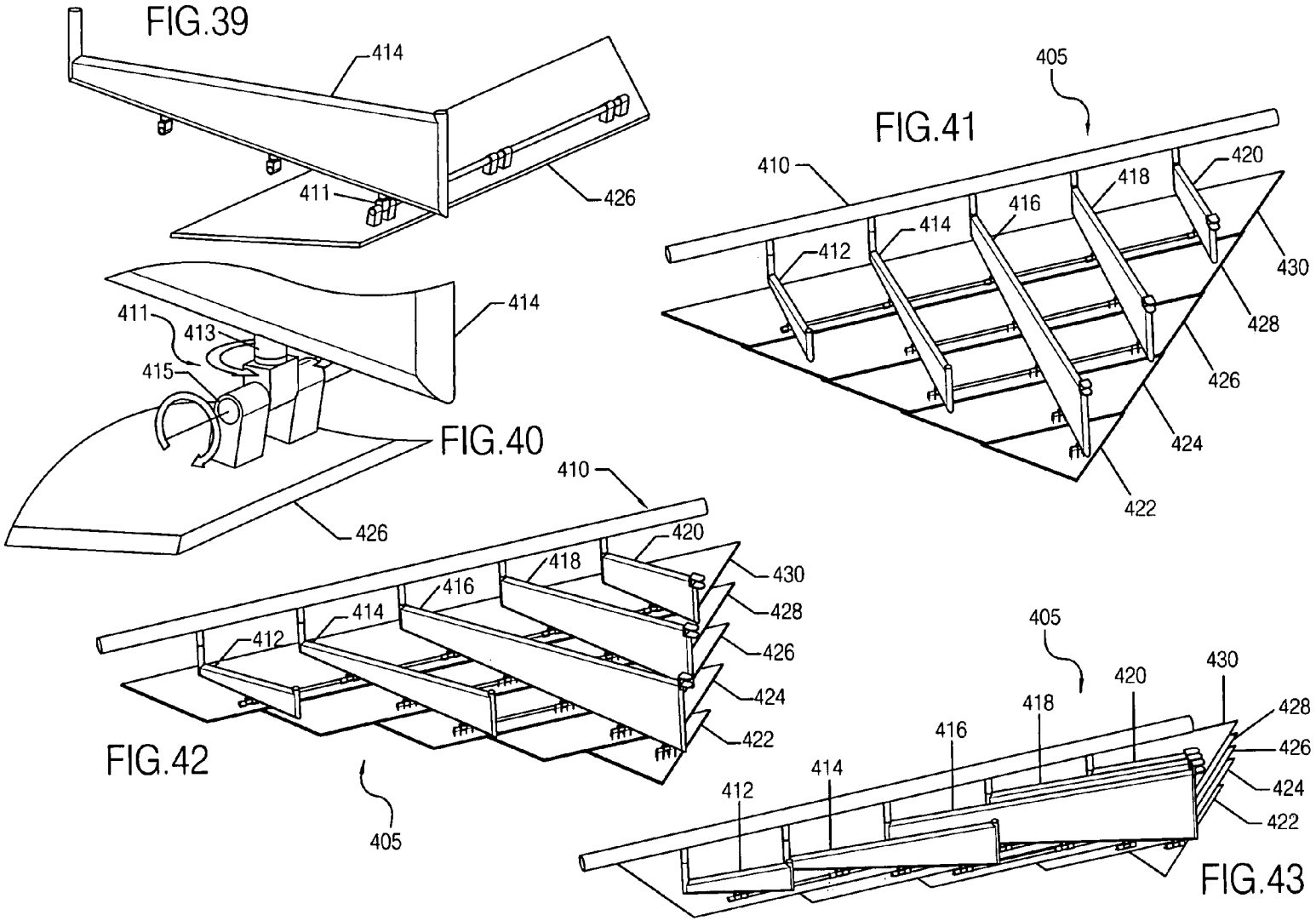
FIG. 39 shows a perspective view of link 414 and a panel 426 which are attached by a compound pivot.
FIG. 40 shows a detailed perspective of pivot 411.
FIG. 41 shows a perspective view of assembly 405.
FIGS. 42 and 43 show perspective views of assembly 405 in a partially extended and retracted position respectively.

FIG. 39 shows a link 414 and a panel 426 which are attached by connection 411. FIG. 40 shows a detailed view of connection 411 which is comprised of two separate pivots 413 and 415. Pivots 413 and 415 have axes which intersect at a right angle to one another.

FIG. 41 shows a perspective view of assembly 405 which is comprised of five links 412, 414,416, 418 and 420. Assembly 405 is further comprised of five panels 422, 424, 426, 428 and 430. Assembly 405 is further comprised of base link 410 to which the five other links are pivotally attached. Each panel is attached to one or more links by a connection which is a compound pivot in the manner of connection 411.

FIGS. 42 and 43 show assembly 405 in a partially extended and retracted position respectively.

Figures 44, 45, 46, 47, 48, 49, 50:
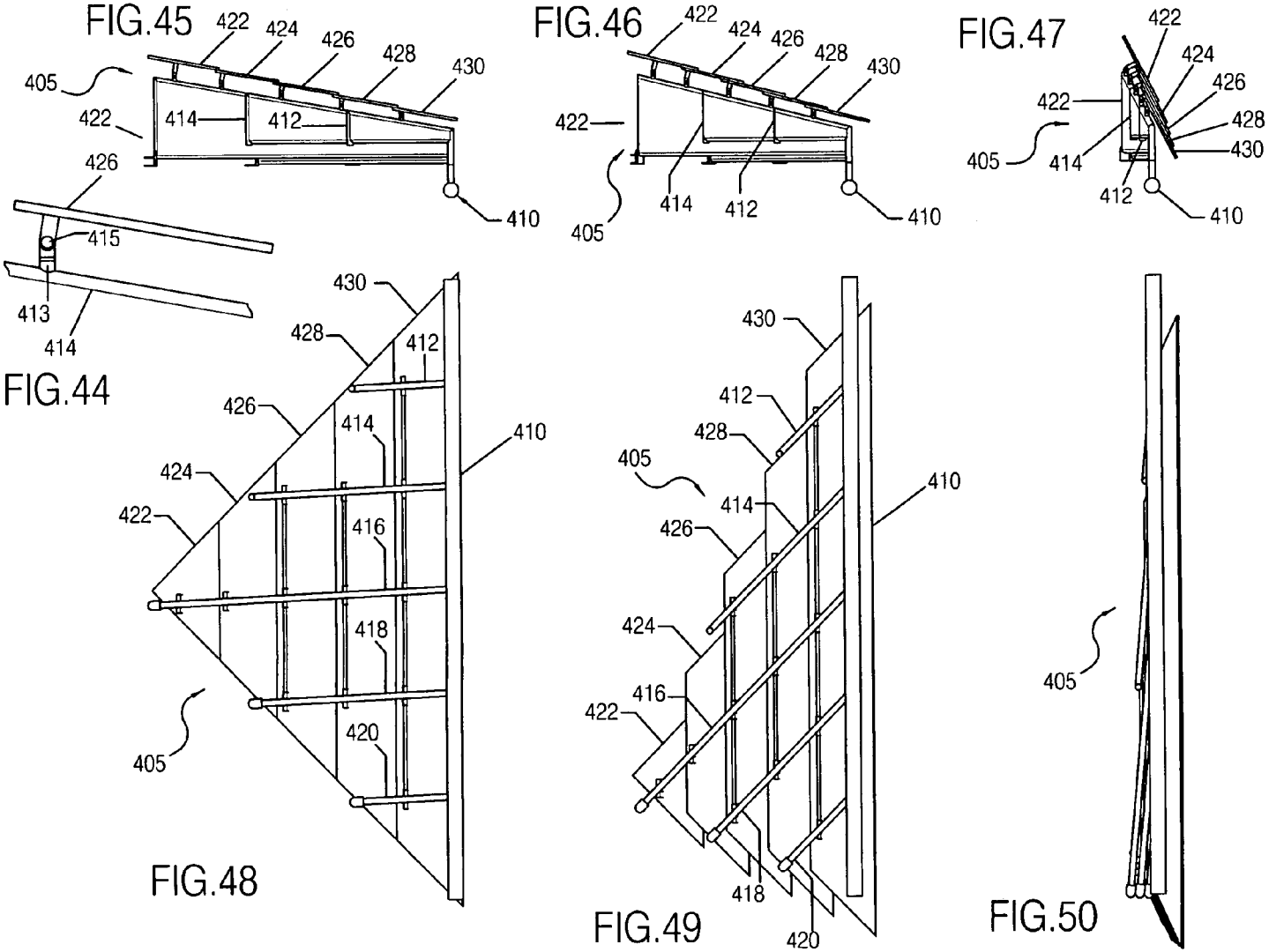
FIG. 44 shows a detailed elevation view of a panel 426 and link 414.
FIGS. 45, 46 and 47 show elevation views of assembly 405 in extended, partially extended and retracted positions respectively.
FIGS. 48, 49 and 50 show plan views of assembly 405 in extended, partially extended and retracted positions respectively.

FIG. 44 shows a detailed elevation view of panel 426 and link 414 which are connected by pivots 413 and 415. It may be seen that pivot 415 provides a means for panel 416 to rotate relative to link 414.

FIG. 45 shows an elevation view of assembly 405 wherein panel 422 rests on panel 424. Similarly the other panels 424, 426, 428 and 430 each rest on their neighboring panel.

FIGS. 46 and 47 show elevation views of assembly 405 in its partially extended and retracted states respectively. As assembly 405 retracts, panels 422, 424, 426, 428 and 430 rotate relative to the links of the assembly such that they stack compactly.

FIGS. 48, 49 and 50 show plan views of assembly 405 in its extended, partially extended and retracted positions respectively.

Figure 51:
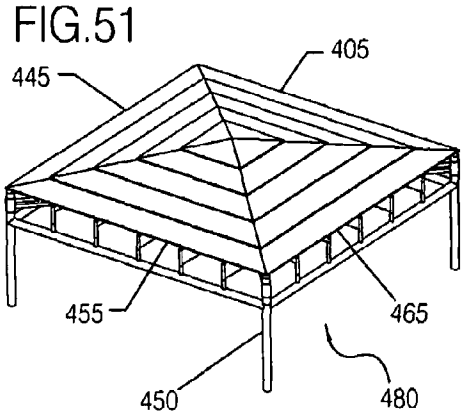
FIGS. 51, 52 and 53 shows perspective views of operable covering 480 in extended, partially extended and retracted positions respectively.

FIG. 51 shows a perspective view of operable covering 480 in its fully extended position. Covering 480 is comprised of four assemblies 405, 445, 455 and 465 and is supported by base 450.

Figure 52:
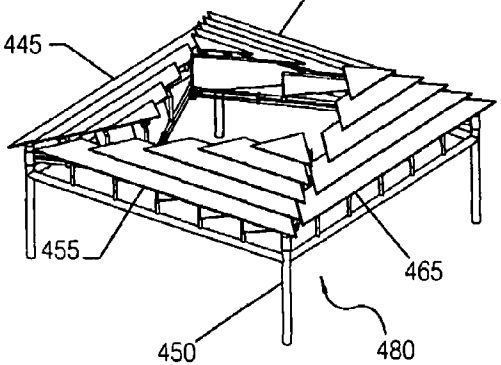
Figure 53:
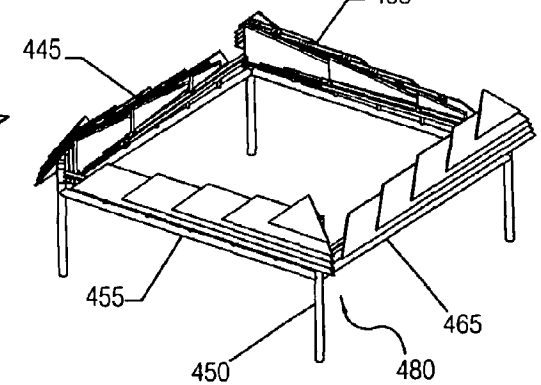

FIGS. 52 and 53 show covering 480 in a partially extended and retracted position respectively.

Figure 54:
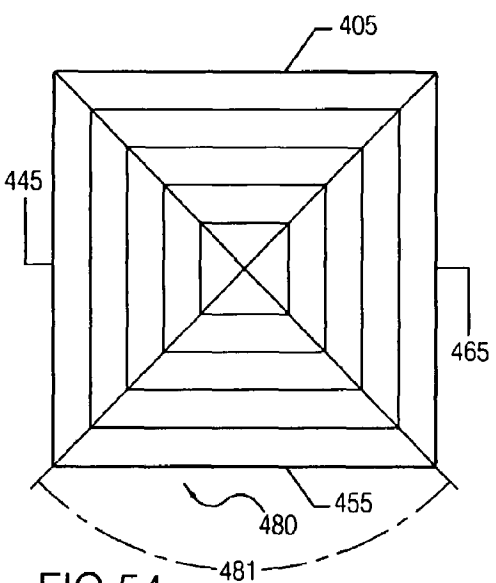
FIGS. 54, 55 and 56 shows plan views of operable covering 480 in extended, partially extended and retracted positions respectively.

FIG. 54 shows a plan view of covering 480 in an extended position. The edges of assembly 455 form an angle 481 which is essentially a right angle.

Figure 55:
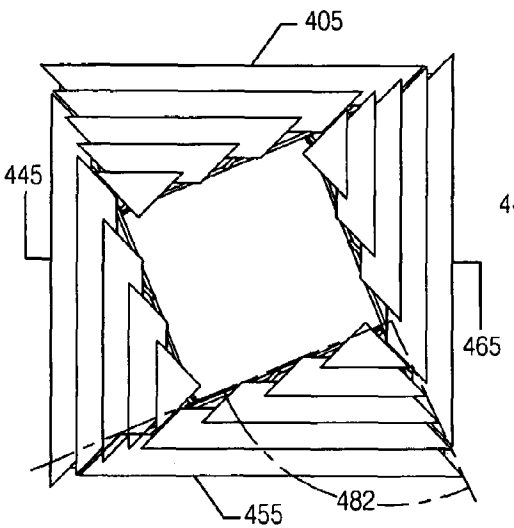

FIG. 55 shows a plan view of covering 480 in a partially extended position. The edges of assembly 455 form an angle 482 which is essentially a right angle.

Figure 56:
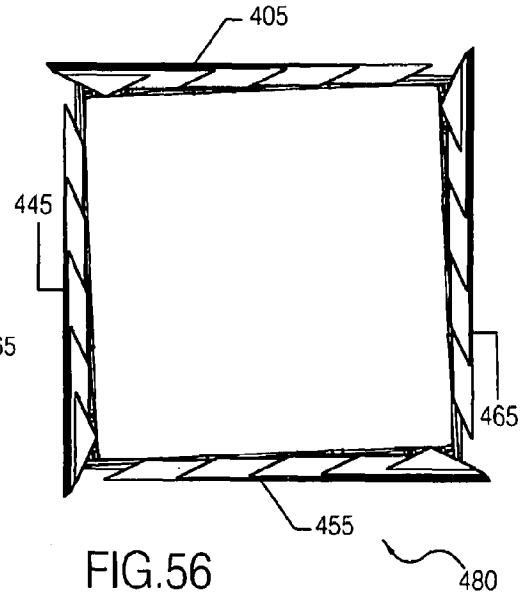

FIG. 56 shows a plan view of covering 480 in a retracted position.

Figure 57:
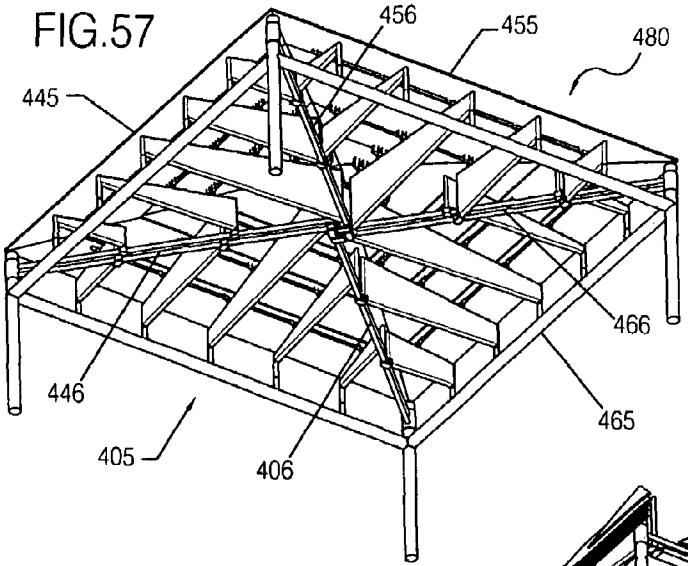

FIG. 57 shows a perspective view from underneath of covering 480 in an extended position. It may be seen that assembly 405 is connected to assembly 445 by linear support 446. Likewise assembly 445 is connected to assembly 455 by linear support 456. Similarly assembly 455 is connected to assembly 465 by linear support 466. In similar fashion, assembly 465 is connected to assembly 405 by linear support 406.

Figure 58:
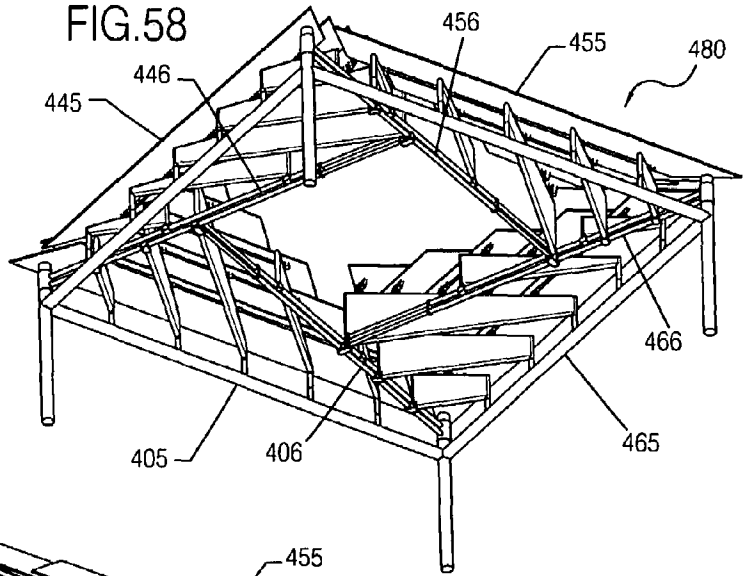
FIGS. 57, 58 and 59 shows perspective views from underneath of operable covering 480 in extended, partially extended and retracted positions respectively, and further show a method of connecting adjacent assemblies.

FIG. 58 shows a perspective view from underneath of covering 480 in a partially extended position. Assembly 405 remains connected to assembly 445 by linear support 446. Support 446 has lengthened itself in a telescoping fashion, its end being attached to support 456. Similarly assemblies 445, 455 and 455, 465 and 465, 405 remain connected together by linear supports 456, 466 and 406 respectively. Further supports 456, 466 and 406 have all lengthened themselves in a telescoping fashion, their ends being attached to their neighboring linear support.

Thus, the telescoping linear supports 406, 446, 456 and 466 provide structural continuity between neighboring assemblies. The ability to provide such connections rests on the constant right angled perimeter of the individual assemblies, which is a unique geometric feature of this embodiment of the invention.

Figure 59:
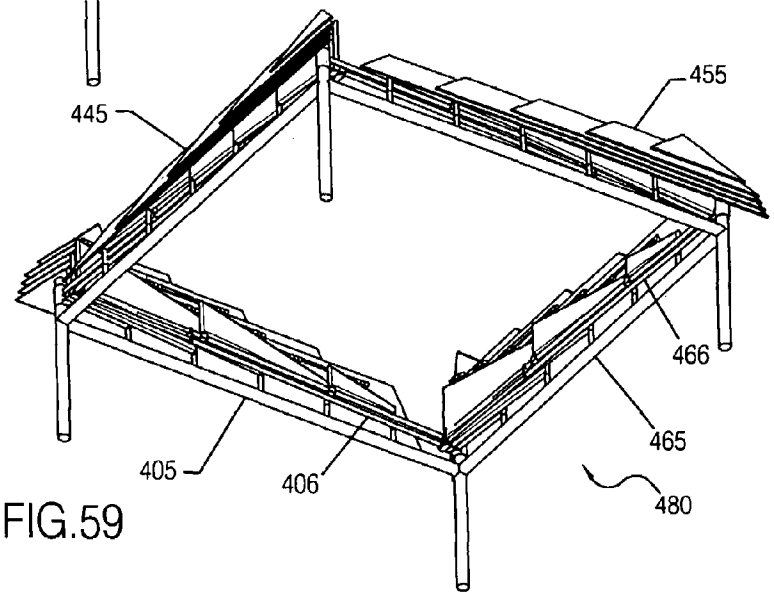

FIG. 59 shows a perspective view from underneath of covering 480 in a retracted position.

Figures 60, 61A, 61B, 62A, 62B, 63A, 63B, 64, 65, 66:
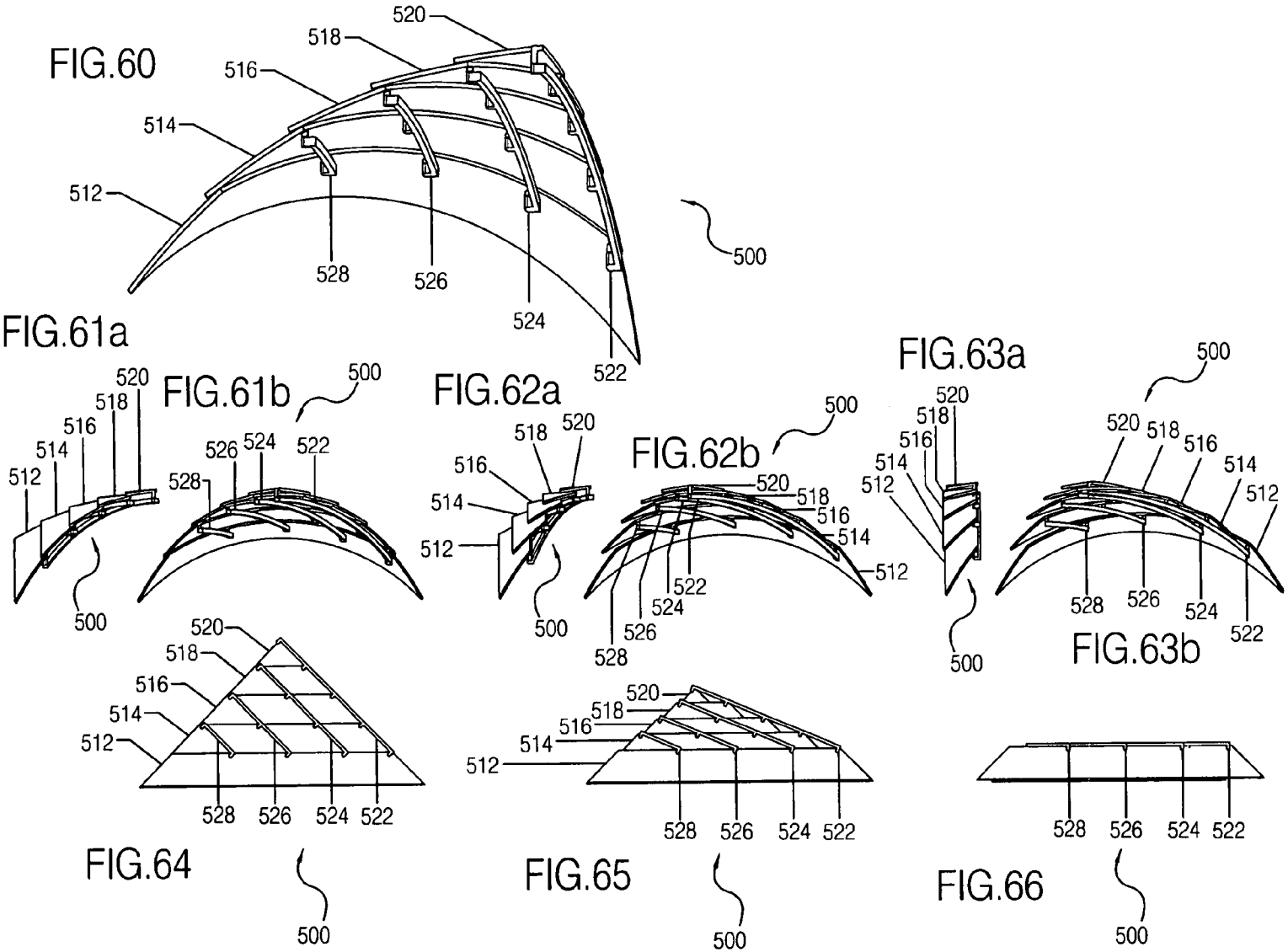
FIG. 60 shows a perspective view of an assembly 500 which is comprised of curved panels and links.
FIGS. 61*a* and 61*b* show side and front elevation views of assembly 500 in an extended position.
FIGS. 62*a* and 62*b* show side and front elevation views of assembly 500 in a partially extended position.
FIGS. 63*a* and 63*b* show side and front elevation views of assembly 500 in a retracted position.
FIGS. 64, 65 and 66 show plan views of assembly 500 in extended, partially extended and retracted positions respectively.

FIG. 60 shows a perspective view of assembly 500 which is in an extended position. Assembly 500 is comprised of five panels 512, 514, 516, 518 and 520 each of which is comprised of a curved surface. Assembly 500 is further comprised of four links 522, 524, 526 and 528 each of which has a curved profile. Assembly 500 thus forms a doubly-curved surface in its extended state.

FIG. 61*a* and 61*b* show side and front elevation views, respectively, of assembly 500 in an extended position. FIGS. 62*a* and 62*b* show side and front elevation views, respectively, of assembly 500 in a partially extended position. FIGS. 63*a* and 63*b* show side and front elevation views, respectively, of assembly 500 in a retracted position. In elevation, it may be seen that the panels and links exhibit their curved aspect.

FIGS. 64, 65 and 66 show plan views of assembly 500 in an extended, partially extended and retracted position respectively. In plan view it may be seen that the panels and links do not exhibit their curved aspect.

Figure 69:
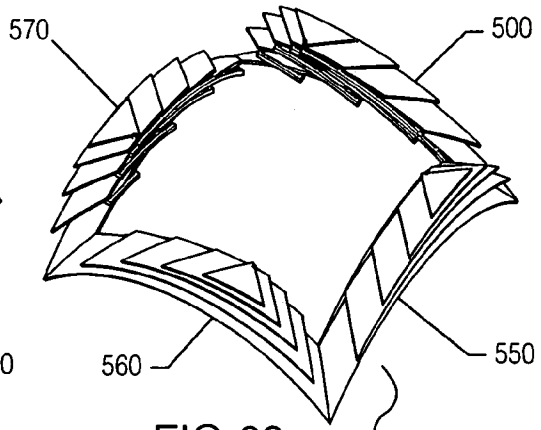
FIGS. 67, 68 and 69 show perspective views of assembly covering 600 in extended, partially extended and retracted positions respectively.
Figure 68:
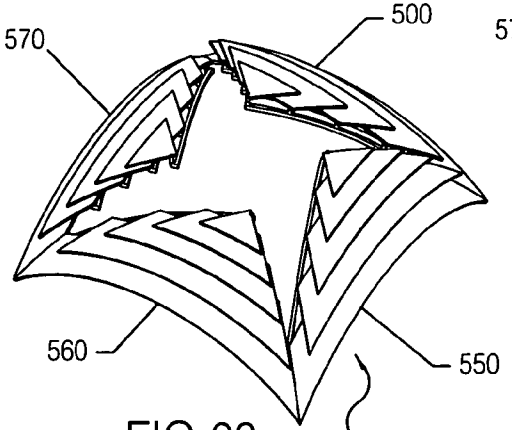
Figure 67:
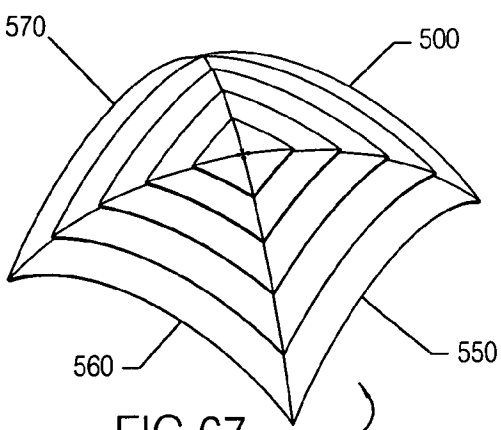

FIG. 67 shows a perspective view of operable covering 600 which is comprised of four assemblies 500, 550, 560 and 570. Covering 58 forms a continuous doubly curved surface. FIGS. 68 and 69 show perspective views of covering 600 in its partially extended and retracted positions respectively.

Figure 72:
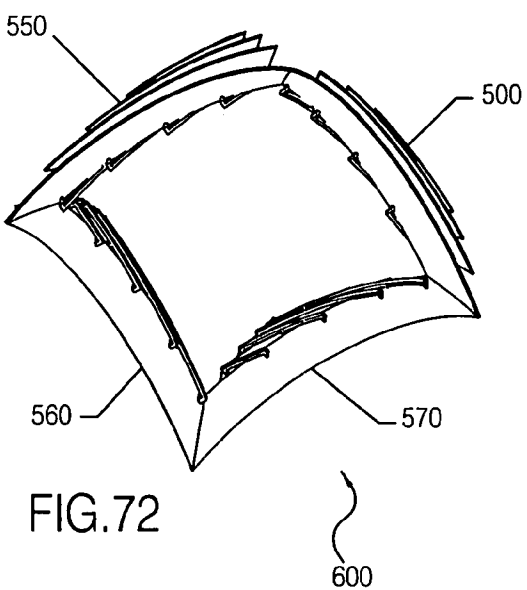
FIGS. 70, 71 and 72 show perspective views of assembly covering 600 from underneath in extended, partially extended and retracted positions respectively.
Figure 71:
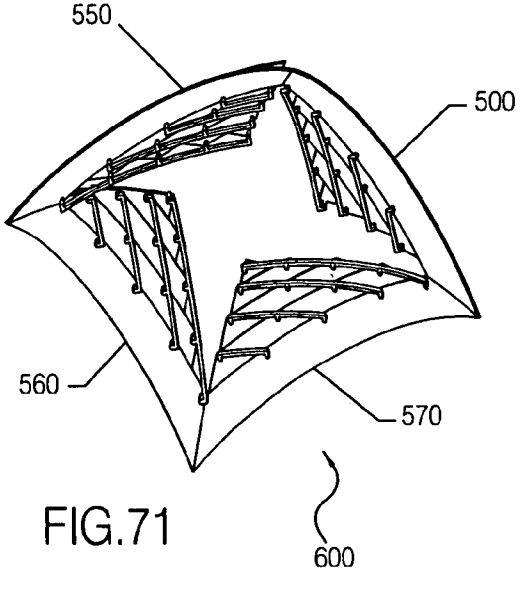
Figure 70:
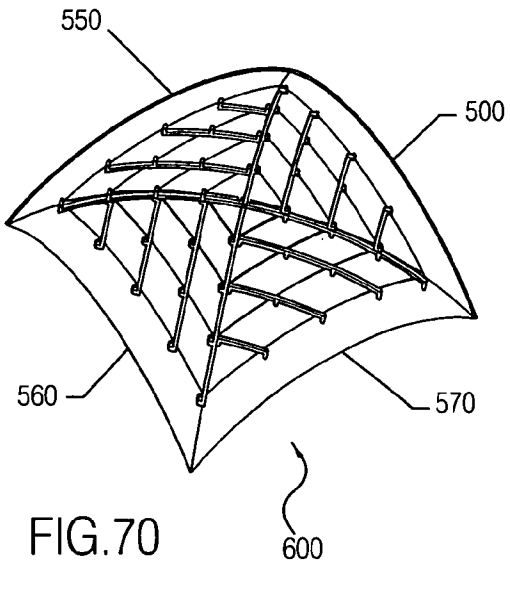

FIGS. 70, 71 and 72 show perspective views of operable covering 600 from underneath such that the links may be seen.

The invention will now be defined in the following claims.

The invention claimed is:

1. An assembly comprising:

first and second links with each link having first and second pivot elements, said first pivot element of each said link having a pivoting axis that is parallel to a pivoting axis of the second pivot element of said link, said first and second pivot elements of each said link being orthogonally offset from one another in a stepwise relationship;

first and second panels with each panel being offset from one another in a stepwise relationship and each having first and second pivot elements, said first pivot element of each said panel having a pivoting axis that is parallel to the pivoting axis of the second pivot element of said panel;

wherein said first pivot element of said first panel is connected to said first pivot element of said first link for defining a first pivot, with said pivot axis of said first panel first pivot element and said first link first pivot element being co-linearly disposed;

wherein said first pivot element of said second panel is connected to said second pivot element of said first link for defining a second pivot, with said pivot axis of said second panel first pivot element and said first link second pivot element being co-linearly disposed;

wherein said second pivot element of said first panel is connected to said first pivot element of said second link for defining a third pivot, with said pivot axis of said first panel second pivot element and said second link first pivot element being co-linearly disposed; and wherein said second pivot element of said second panel is connected to said second pivot element of said second link for defining a fourth pivot, with said pivot axis of said second panel second pivot element and said second link second pivot element being co-linearly disposed.

2. The assembly of claim 1, wherein each said link further includes a base pivot element.

3. The assembly of claim 2, further including a base panel having first and second pivot elements, said first, second and base panels being offset with one another in a step-wise relationship, wherein said base pivot element of said first link being connected to said first pivot element of said base panel in order to define a first base pivot, and said base pivot element of said second link being connected to said second pivot element of said base panel in order to define a second base pivot.

4. The assembly of claim 1, wherein said assembly has a polygonal profile in plan view and a stepped profile in elevational view.

5. The assembly of claim 1, wherein said assembly is moveable between a first extended position in which said panels form a stepped surface having a polygonal profile and a second retracted position in which said panels are stacked one over the other in order to form a linear bundle.

6. The assembly of claim 5, wherein, for any position between said first and second positions, said first, second, third and fourth pivots together define a parallelogram.

7. The assembly of claim 5, wherein said first and second panels are in at least a partially overlapping relationship with one another even when said assembly is in said extended position.

8. The assembly of claim 1, wherein said first and second panels each comprise a panel member and first and second protrusions for defining said first and second panel pivot elements.

9. A covering comprised of two or more assemblies according to claim 1, wherein the edges of the assemblies are essentially in contact with one another such that a continuous surface is formed when they are in an extended position.

10. A covering comprised of two or more assemblies according to claim 1, wherein the edges of the assemblies are in an overlapping condition to one another for all positions.

11. A covering comprised of two or more assemblies according to claim 1, wherein linear supports connects neighboring assemblies to each other for all positions.

12. An assembly according to claim 5, wherein the links and panels take on an essentially parallel condition when the assembly is in the second retracted position.

13. An assembly according to claim 1, wherein the panels are essentially planar.

14. An assembly according to claim 1, wherein the links are essentially straight.

15. An assembly according to claim 1, wherein the links are curved.

* * * * *